United States Patent [19]

Peevey

[11] 4,068,729

[45] Jan. 17, 1978

[54] APPARATUS FOR MULTIPLE WELLS THROUGH A SINGLE CAISSON

[75] Inventor: Robert M. Peevey, Carriere, Miss.

[73] Assignee: Standard Oil Company (Indiana), Chicago, Ill.

[21] Appl. No.: 768,019

[22] Filed: Feb. 14, 1977

Related U.S. Application Data

[63] Continuation-in-part of Ser. No. 696,327, June 14, 1976, abandoned.

[51] Int. Cl.[2] ..... E21B 15/02

[52] U.S. Cl. ..... 175/8; 61/98; 166/.5; 175/61

[58] Field of Search ..... 175/78, 9, 61, 79; 166/.5, .6; 61/94, 98

[56] References Cited

U.S. PATENT DOCUMENTS

| | | | |
|---|---|---|---|
| 1,900,163 | 3/1933 | Dana et al. | 175/61 X |
| 2,503,516 | 4/1950 | Shrewsbury | 175/8 |
| 3,390,531 | 7/1968 | Johnston et al. | 175/9 X |
| 3,542,125 | 11/1970 | Sizer | 166/.6 |
| 3,601,189 | 8/1971 | Weiss et al. | 175/7 X |
| 3,665,721 | 5/1972 | Wyllie | 175/9 X |

*Primary Examiner*—Ernest R. Purser
*Assistant Examiner*—Richard E. Favreau
*Attorney, Agent, or Firm*—R. A. Stoltz

[57] ABSTRACT

A multiple well platform is described for producing hydrocarbons, preferably using a free-standing single riser caisson. Although the wells are connected up to the surface, the largest casings (and preferably most of the other casings) are terminated at about the mudline. The apparatus uses a guide located at a level about the ocean floor which can be oriented to direct well installing apparatus to any of several exit holes and enables multiple wells to be installed through a riser caisson only slightly larger than the diameter of the largest size well casing. The apparatus preferably has a single riser caisson to extend from about the marine bottom to above the water level with at least one buoyancy chamber attached to its upper portion, and an enlarged bottom section. The bottom section contains the guide means to direct apparatus such as drills and casing into appropriate exit holes.

10 Claims, 11 Drawing Figures

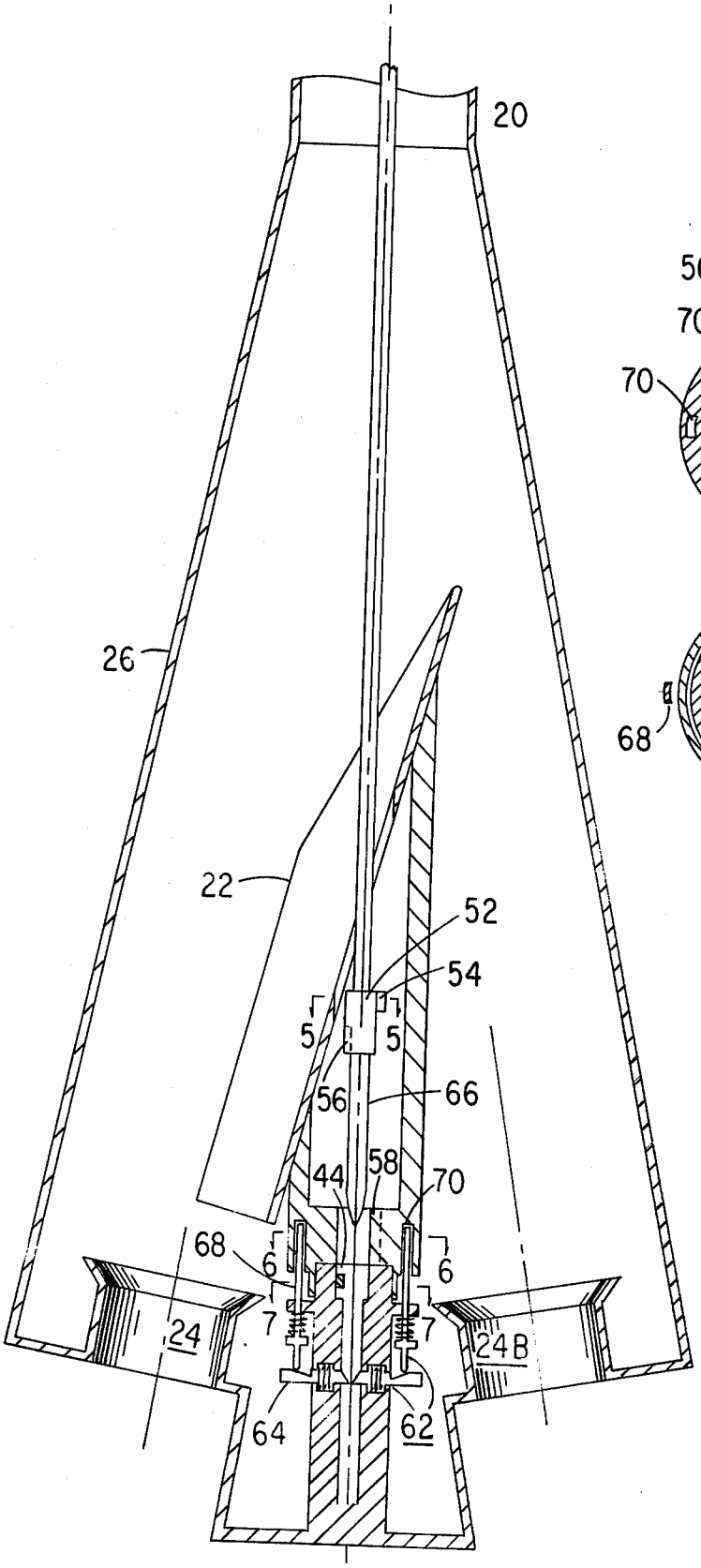
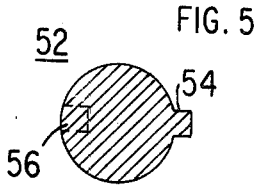
FIG. 5
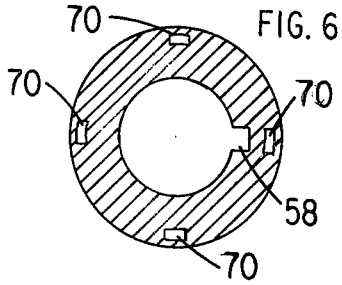
FIG. 6
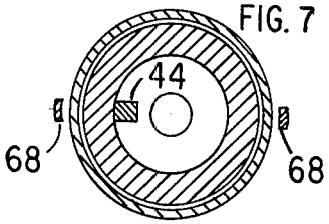
FIG. 7
FIGURE 4

APPARATUS FOR MULTIPLE WELLS THROUGH A SINGLE CAISSON

CROSS-REFERENCE TO RELATED APPLICATION

This application is a continuation-in-part of co-pending application Ser. No. 696,327, filed June 14, 1976 now abandoned.

BACKGROUND OF THE INVENTION

This invention relates to marine drilling platforms for the production of hydrocarbons, and, more particularly, to a relatively small and inexpensive platform.

The use of platforms for the development of hydrocarbon reserves in deep water is extremely expensive. Often, small reservoirs are bypassed because of the lack of economic return because of the high cost of a platform to develop them.

One alternative to the use of deepwater platforms is the subsea completion. However, this method is also relatively expensive and requires some type of surface facility to process and treat the hydrocarbons.

A similar problem exists in the development of fringe areas of a reservoir which cannot be developed from a major platform. In addition, there is often some uncertainty as to the productivity of what may be a relatively large reserve area and further information is desirable prior to the final design and/or commitment of a major platform.

The typical platform in use today is the battered leg platform. The cost of such platform rises very steeply as the depth of the water increases. At greater depths, the vertically moored platform (in which the legs of the platform are essentially parallel) is less expensive than the battered leg platform. The vertically moored platform is described in U.S. Pat. Nos. 3,559,410, issued to Blenkarn and Dixon, and 3,648,638, issued to Blenkarn. While such an arrangement can be less expensive than the conventional battered leg platform, the costs are still high and such platforms cannot be used to economically develop relatively small reserves.

A number of platform arrangements providing alternatives to major platforms have been proposed. A shallow-water platform using a single riser caisson, but with the wells drilled outside the caisson, is proposed in U.S. Pat. No. 3,881,549, issued to Thomas, May 6, 1975. An unusual single caisson arrangement is proposed in U.S. Pat. No. 3,364,684, issued to Sandberg, Jan. 23, 1968. Arrangements have also been proposed in which the wells are completed at an intermediate depth (rather than either above the water level or on the ocean floor). Such arrangements are described in U.S. Pat. No. 3,556,210, issued to Johnson, Jan. 19, 1971, U.S. Pat. No. 3,470,838, issued to Daniell, Oct. 7, 1969, and U.S. Pat. No. 3,380,520, issued to Pease, Apr. 30, 1968. These intermediate depth well arrangements avoid the problem of divers having to work at extreme depths, but the use of the divers, even at these intermediate depths is still quite expensive.

None of the prior art methods provide a proven, economical method of developing hydrocarbon reserves when a limited number of wells need be drilled in deepwater location.

SUMMARY OF THE INVENTION

This invention provides a multiple well platform apparatus for producing hydrocarbons using multiple wells drilled through a single riser caisson and with no exterior legs or cables required in maintaining the position of the platform. The apparatus preferably has a free-standing single riser caisson adapted to extend from about the marine bottom to above the water level, at least one buoyancy chamber attached to the upper end of the caisson, and a bottom section connected to the lower end of the single riser caisson. A holddown means is generally located on the marine bottom, and attached to the bottom section. The bottom section typically is tapered and has a plurality of downwardly looking exit holes, each exit hole being adapted to receive a largest size casing. An orientable guide means is located inside and generally on the vertical axis of the bottom tapered section.

The guide means can be oriented to direct well drilling apparatus to any of the exit holes. A largest size casing (drive or structural casing) for each well can be mounted in each exit hole (one or more exit holes could be saved for possible future wells) with the top of the largest size casing being at about the level of the exit hole. The diameter of the largest size casing compared to the diameter of said single riser caisson is such that the largest size casings from all of the exit holes would not simultaneously fit in said single riser caisson. Otherwise stated, if the largest casings were packed together as closely as possible, the smallest circle which could be drawn to include all of them would be larger than the inner diameter of the caisson.

Generally, either a keying arrangement is provided to fix the orientation of the guide means, or a ratcheting means is used. Lifting and then lowering the guide can cause ratcheting to reorient the guide means such that the guide means will direct apparatus such as drills and casings to an adjacent exit hole (clockwise or counterclockwise as determined by the design of the ratcheting means). A piston can be positioned to raise and lower and thereby, in conjunction with the ratcheting means, reorient the guide means.

BRIEF DESCRIPTION OF THE DRAWINGS

The invention will be further described by reference to the following drawings in which:

FIG. 4 is an elevation, partly in section, of an embodiment in which one of a set of special orientation tools is used to reorient the guide means;

FIG. 5 is a horizontal section taken through the upper portion of the special orientation tool of FIG. 4;

FIG. 6 is a horizontal section taken through the lower support portion of the guide means of FIG. 4;

FIG. 7 is a horizontal section taken generally through pedestal support portion of the bottom section of FIG. 4;

DESCRIPTION OF THE PREFERRED EMBODIMENTS

Figure 1:
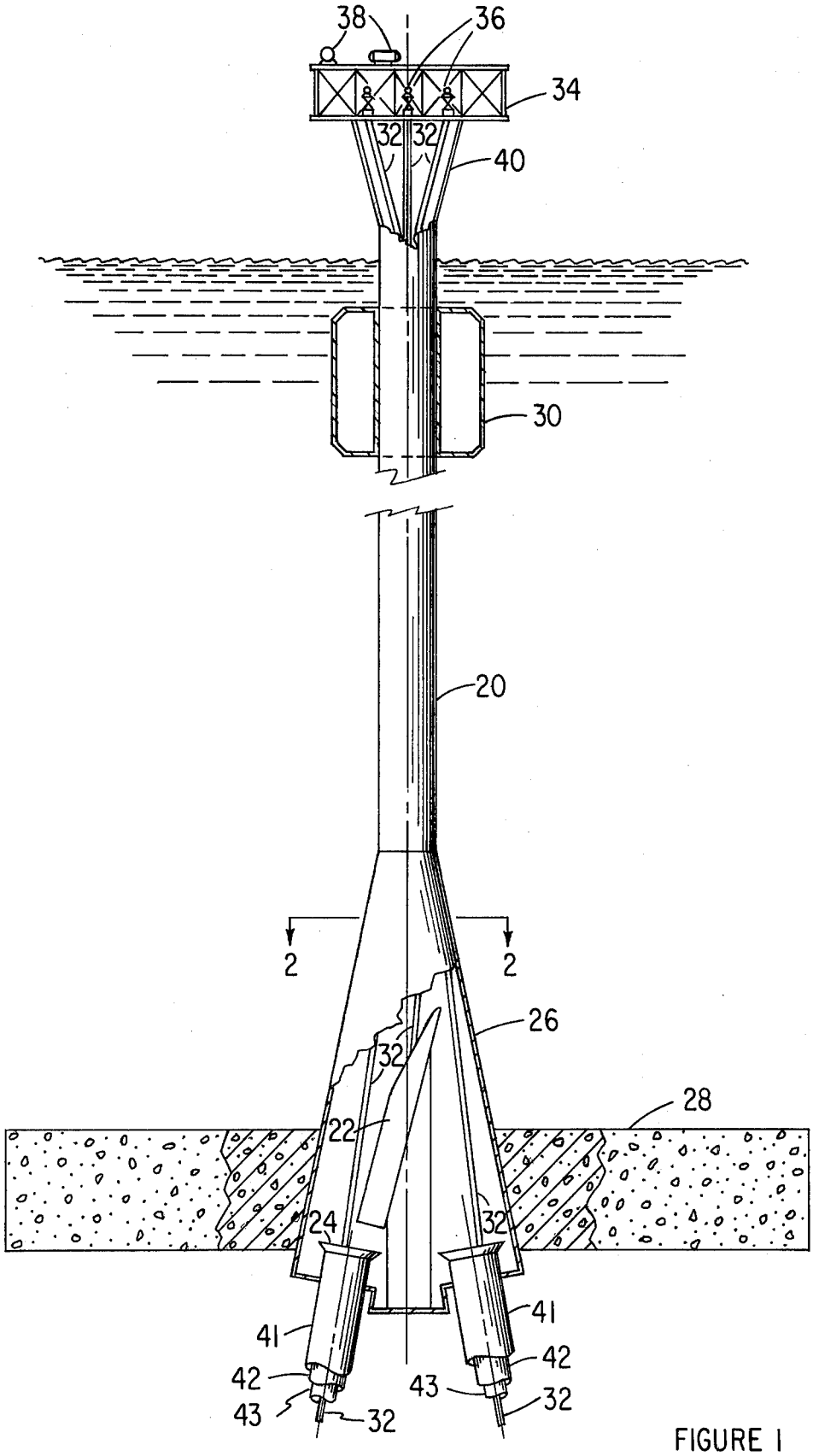
FIG. 1 is an elevation, partly in section, showing a four-well marine platform.

FIG. 1 illustrates a production platform in accordance with this invention. The wells are preferably drilled down the free-standing (not supported by external legs or cables) single riser caisson 20. The guide 22 is oriented to the proper exit hole 24 to direct the drilling apparatus and casings out appropriate exit holes 24 at the bottom of the lower section 26. The holddown means 28 (a concrete gravity base is shown, but piles appropriately attached to the lower section 26 could also be used) can hold the platform apparatus in place. At least one buoyancy chamber 30 keeps the major art of the caisson 20 in tension. After all the drilling is complete and the small casing strings 32 on all of the wells are run to the top of the caisson 20, the deck 34 is installed with appropriate trees 36, and other appropriate production equipment 38. In this embodiment, an upper tapered section 40 is used to conveniently provide greater spacing between the trees 36. The largest casings 41 are only slightly smaller than the single riser caisson 20, such that large casings can be lowered down individually through the caisson 20, but the single riser caisson 20 is relatively small and is not large enough to hold all of the largest casings 41 simultaneously. While the use of a relatively small single riser caisson is a significant cost reduction, it does not allow for all of the casings 41 to be brought to the top simultaneously, and thus the largest casings 41 must be terminated at about the mudline and generally are hung from the lower section 26. A guide 22 is required to direct the drilling apparatus and casings through the appropriate exit hole 24 and the guide must be reoriented when work is to be done on a different well through a different exit hole.

It should be noted that this type of platform is intended to be generally unmanned during production and that the drilling is generally done by some portable drilling apparatus, such as a drillship. Being unmanned, no effort is made to maintain the platform deck 34 in a horizontal position after the wells have been completed and the deck 34 will tilt as wind or waves bend the caisson 20 from the vertical position.

It is generally preferred that only the smallest size casing string is brought up to the surface and that all of the larger casing strings be hung with their tops about level with the mudline. Arrangements could be made, however, to terminate the smallest casing string as well at the mudline and to bring only tubing to the surface. Conversely, one or more of the intermediate size casings could be brought to above the water level. Again, however, it is felt that the cheapest and most convenient method is to bring only the smallest casing string 32 from each well to the surface, as shown in FIG. 1.

Generally, the single riser caisson 20 is intended to be only large enough in diameter to conveniently lower a single casing of the largest size through at one time. Typically, the largest casing 41 is a drive or structural casing which is set by drilling, driving, or jetting. A 30-inch drive casing 41, for example, can be lowered through a 40-inch caisson 20 and directed into an appropriate exit hole 24 by the guide means 22 and set by drilling, driving or jetting in such that the drive casing 41 extends from the exit hole down to perhaps 150 feet below the mudline. The guide 22 could then be reoriented and an additional drive casing 41 inserted for another well, and this process repeated until a drive casing 41 had been placed for each of the wells of this particular platform. Generally, less than ten wells (typically three to six) would be drilled from any one given platform.

Drilling could then be performed for conductor pipe 42, such as a 16-inch conductor. Again, the guide 22 is reoriented to provide access in turn to each of the wells. The conductor pipe 42 is again preferably hung from the exit hole 24 which is about the mudline and may extend down typically between 400 and 1000 feet.

Drilling can then be begun for the surface casings 43 and then the surface casings 43 run. It will be noted that with the piston-activated ratcheting means (described hereinafter) to reorient the guide 22, the drill need not be completely removed but can be pulled up into the caisson 20, the guide 22 reoriented, and the drill lowered to begin drilling in an adjacent hole. The surface casing 43 is also preferably hung from about the mudline.

All drilling can proceed on each well before moving to the next well, as has typically been done in the past. Alternately, drive casings 41 can be set for all wells, then all conductor casing 42 set, then all surface casing 43 set. The latter should generally save time and cost and has the additional advantage that the casings (especially drive and conductor) will provide foundation support.

The small string casing holes can then be drilled and the small casings 32 run, with the small casings 32 preferably being hung from near or above the water level. It will be noted that the small strings are typically about 5- or 7-inch pipe, and that even with 7-inch pipe there is more than sufficient room for all of the wells (again generally less than 10) to be brought to the surface.

Figure 2:
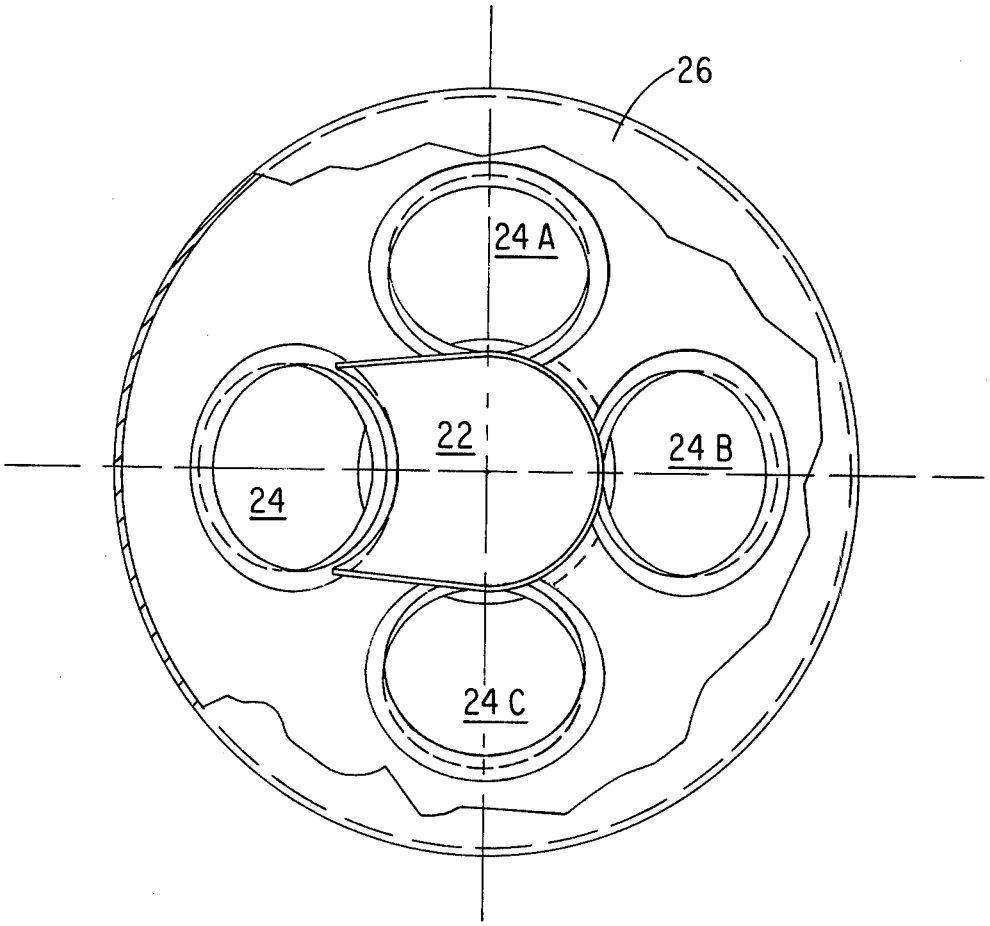
FIG. 2 is a plan view of a section taken through the bottom section of FIG. 1.

FIG. 2 shows a plan view through the bottom section 26, looking down on the guide means 22. This particular embodiment shows four exit holes 24, 24A, 24B, 24C, with the guide means 22 oriented to direct well installation apparatus to the hole on the left 24. The bottom of the bottom section 26 is larger in diameter than the caisson in order to provide room for all the exit holes and is preferably tapered as shown in FIG. 1.

Figure 3:
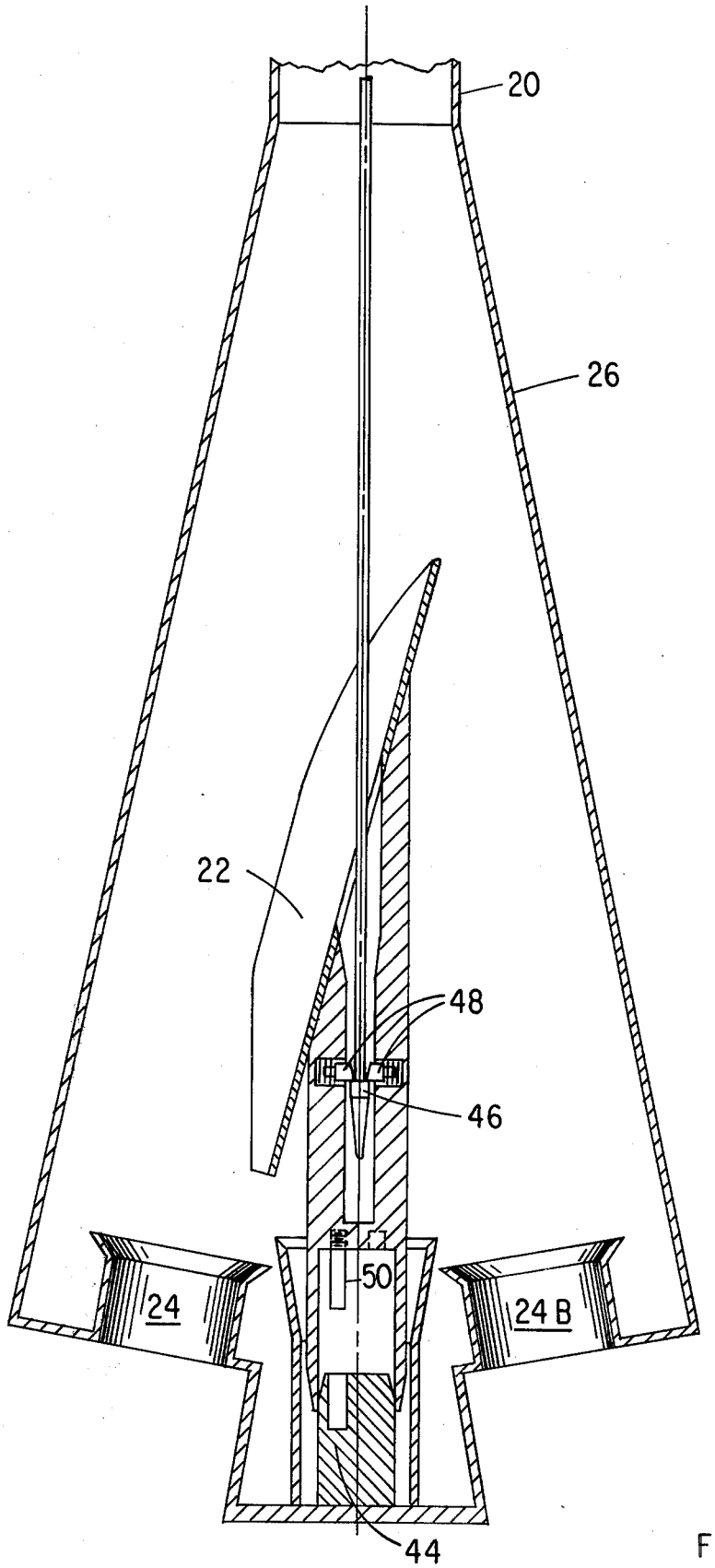
FIG. 3 is an elevation, generally in section, of the lower portion of an embodiment of the apparatus showing the guide means having a key mating means to mate with the keying means on the bottom of the bottom tapered section.

FIG. 3 shows an embodiment in which orientation of the guide means is provided by a key arrangement (as opposed to the ratcheting arrangement described hereinafter). The keying means 44 is mounted on the bottom section 26 and will lock the guide means 22 in a predetermined position when the guide means 22 is rotated from above. The entire guide assembly or its key orientation can be changed by pulling the guide assembly to the surface with wireline tools (well known in the art, and described in U.S. Pat. Nos. 2,887,163; 3,207,222; 3,294,173; and 2,920,704, for example). FIG. 3 shows the guide being lifted by a mechanical lifting means (here, a pulling tool 46), which has engaged lifting spring-loaded dogs 48.

Thus, FIG. 3 shows a guide 22 oriented to direct tools to the exit hole 24 on the left, and which relationship was developed by the keying means 44 and the key mating means 50. If tools are to be directed to a different exit hole, a tool 46 is lowered from the surface down through caisson 20 and fastened to the guide 22 by engaging the mechanical lifting adapter (here, lifting spring-loaded dogs 48) which is attached to the guide means 22. The pulling (or reinserting) can generally be done with any commercial wireline nipple and pulling (or running) tool combination. The guide means 22 with its key mating means 50 is then pulled up through the caisson 20 and removed. A new guide configuration (havng a key mating means 50, which is so oriented that when the key mating means 50 is engaged with the keying means 44, the drilling apparatus will be directed out a different exit hole) is lowered and then rotated until the key mating means 50 engages the keying means 44.

The key mating means 50 can be an integral part of each of a set of guide means, or the key mating means 50 can be replaceable (or repositionable) and thus only that subassembly need be replaced (or repositioned) to provide for reorienting the guide 22.

FIG. 4 shows another alternative, and uses a special orientation tool 52 which mates in a predetermined position in the guide 22 and then rotates the guide 22 until the orientation tool also mates with the keying means 44. Thus, the guide is reoriented with a single trip of the tool.

The special orientation tool 52 is one of a set of orientation tools in which there is one tool for each exit hole. This particular tool 52 is the tool for the exit hole 24, shown on the left, and has a tab 54 located at 180 degrees with respect to the slot 56 (as can be seen in the section in FIG. 5). The tab 54 will fit into groove 58 of the guide means 22 (the groove 58 is shown in the section in FIG. 6). If the guide 22 were in any other position than that shown in FIG. 4, the orientation tool 52 would not go down on the keying means 44 (the keying means 44 is shown in the section in FIG. 7) as the slot 56 would not be aligned with the keying means 44. The tool 52 is to be torqued to rotate the guide 22 while a downward force is maintained on the tool 52. When the guide 22 gets into the position shown in FIG. 4, the key mating means (the slot 56) and keying means 44 are aligned and the tool 52 will drop down over the keying means and rotation will stop. The torquing force is then removed and the tool 52 is lifted out, up through the caisson 20.

The configuration of the tool (the respective position of the tab 54 and the slot 56) determines to which exit hole the guide 22 will be oriented. The orientation tool for the exit hole on the right 24B, for example, would have a slot directly below its tab.

FIG. 4 also shows a locking mechanism 62 to prevent rotation of the guide 22 after the orientation tool has been removed. First spring-loaded members 64 are pushed out by probe 66 on the orientation tool 52. This allows second sprng-loaded members 68 to come down out of hole 70 (see also FIGS. 6 and 7), and allows the orientation tool 52 to rotate the guide 22. Removing probe 66 (when the orientation tool 52 is removed) allows the heavier springs of the first members 64 to compress the weaker springs of the second members 68 and the second members 68 go up into holes 70 in the guide 22 and thus lock the guide 22 against rotation.

Figure 8:
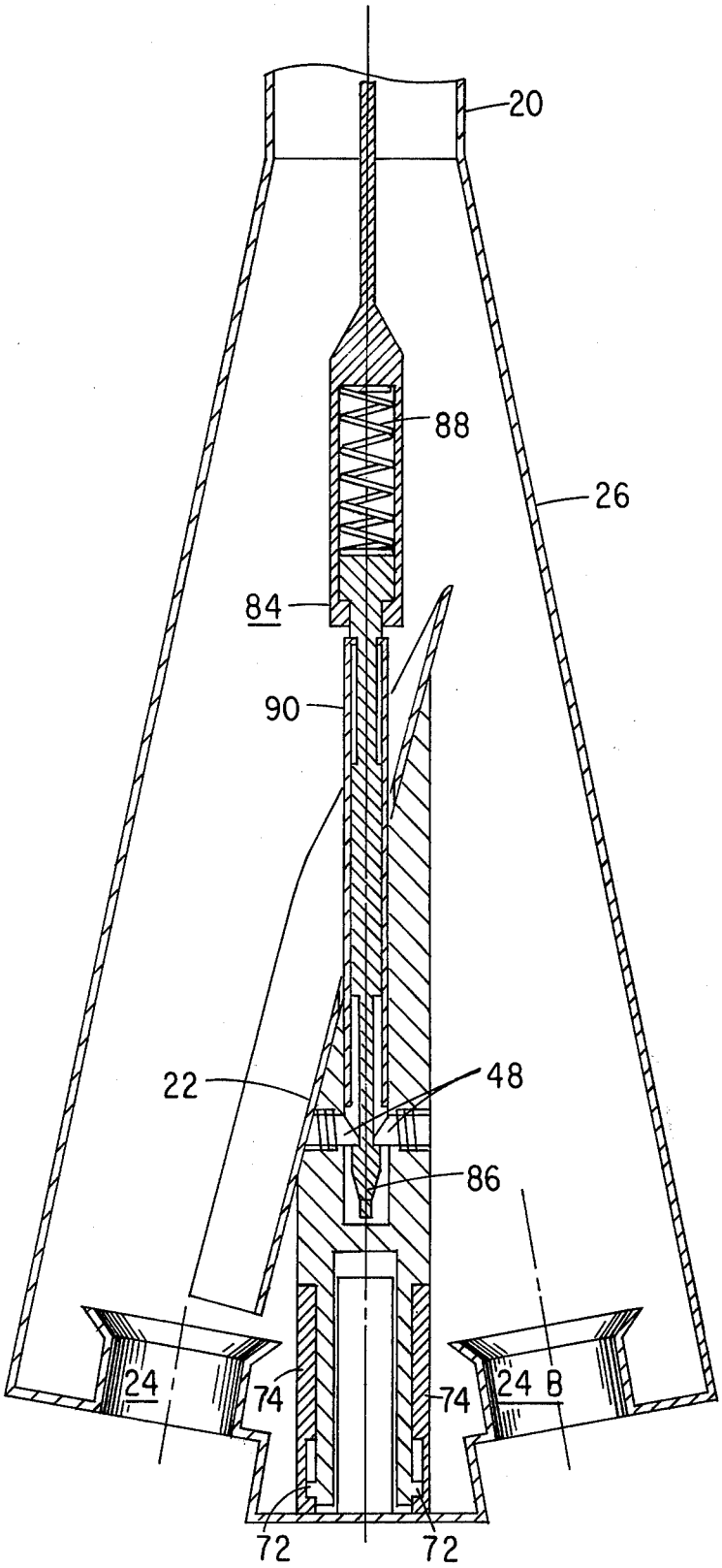
FIG. 8 is an elevation, partly in section, of the lower portion of a ratcheting type of embodiment where the guide is reoriented to an adjacent exit hole by lifting and then lowering the guide.

As an alternative to keying the guide 22 to a specific exit hole 24, mechanisms can be used which cause the guide means 22 to ratchet from one exit hole to the next exit hole in a predetermined direction (either clockwise or counterclockwise). Ratcheting devices which reorient the guide means 22 without lifting the guide means 22 could be built. A mechanism which reorients the guide means 22 by lifting it and then lowering it is, however, preferred because of its simplicity and reliability of operation. FIG. 8 shows a ratcheting type of embodiment where the guide 22 is reoriented to an adjacent hole by a wireline type of tool which lifts and then lowers the guide 22. One or more pins 72 are mounted on the guide 22 protruding out radially from the vertical axis. These pins 72 ride in grooves in the collar 74, which grooves are shaped such that when the guide 22 is lifted and then lowered back into place, the pins 72 cause the guide to be rotated to the adjacent exit hole. Thus, the guide 22 which is oriented towards exit hole 24, as shown, could be oriented toward the adjacent exit hole directly behind the guide 24A, for example. While a single pin 72 could be used, it is convenient to use as many pins as there are exit holes.

Figure 9:
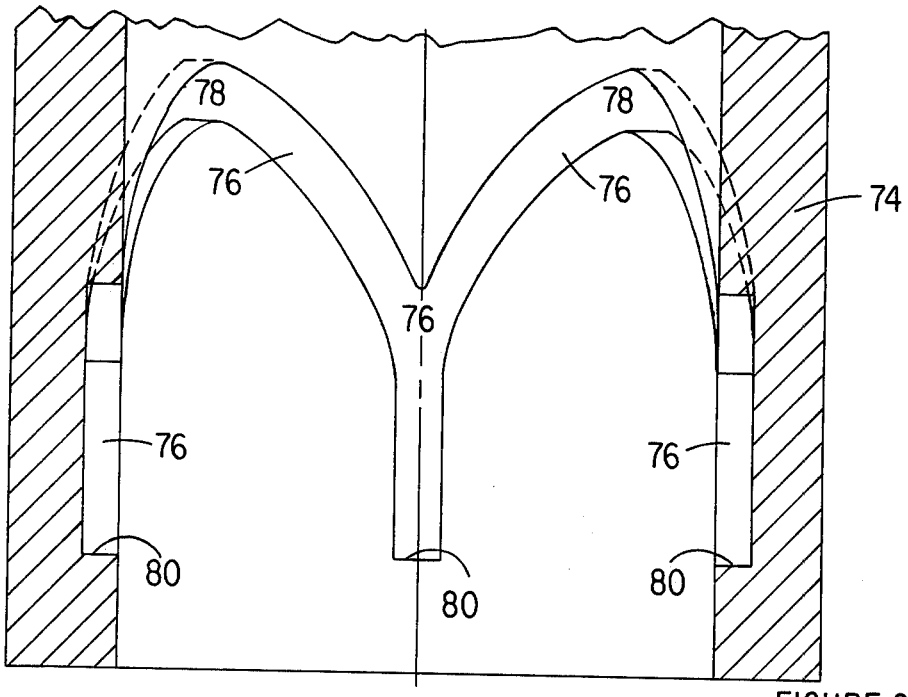
FIG. 9 is a section of the lower portion of the outer collar of the ratchet assembly showing the groove in the outer collar.

FIG. 9 shows an elevation view of a section of a collar 74. When the guide assembly is lifted, pins sticking radially out into the groove 76 will cause the guide to rotate until the pins reach the high point 78 in the groove 76. In this particular groove configuration, the guide will also rotate as the guide is lowered, until the pins reach the low point 80, at which time, the guide will be reoriented to an adjacent exit hole.

Figure 10:
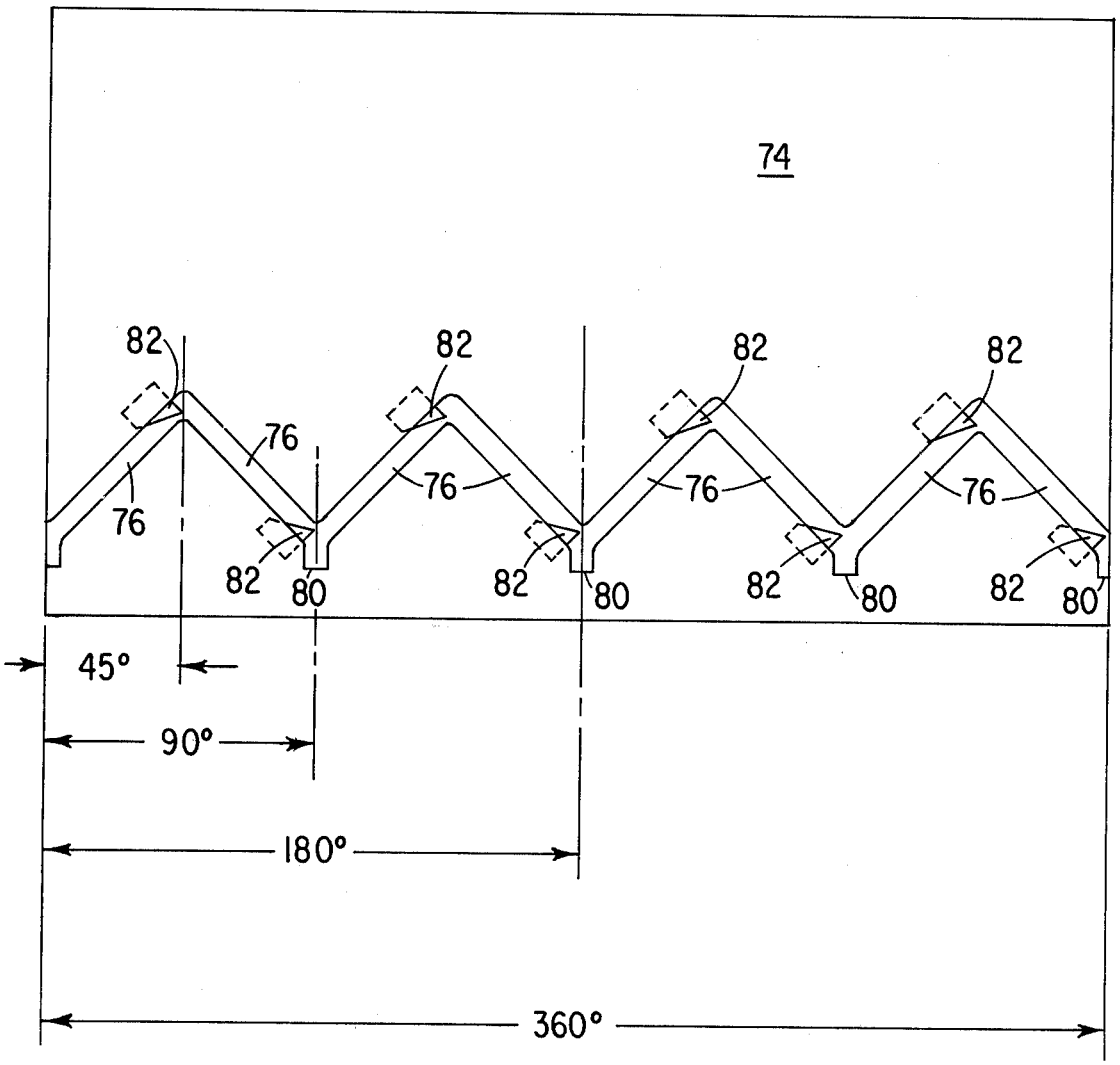
FIG. 10 shows an outer collar of the ratchet assembly as it would look if it were cut vertically and laid out flat.

The configuration of the groove 76 in the collar 74 can perhaps more easily be seen by viewing FIG. 10, which shows the collar 74 as it would look if one side of the generally cylindrical collar were cut vertically through one low point 80 of the groove 76 and the collar flattened. A pin riding in the slot 76 in the flattened collar 74 would go from left to right one position each time the pin is raised to a high spot in the groove and then lowered to a low spot 80. Each low spot 80 corresponds to an exit hole. The ratchet spring-loaded dogs 82 assure that the pin travels in the right direction.

FIG. 10 (as well as the other figures) is for a four-exit hole configuration and could be used for up to four wells. The groove design would, of course, have an appropriate number of low points 80 to provide one low point for each well.

The mechanically actuated ratcheting arrangement of FIG. 8 requires a tool which will first grip, then release the guide 22 and some commercial wireline tools will do this. The tool assembly 84, shown in FIG. 8, can be inserted in the guide 22 with moderate pressure such that the tip 86 goes down past the lifting spring-loaded dogs 48. The tool 84 can then be used to raise and then lower the guide 22 to cause it to ratchet to the next position (because of the interaction of the pins 72 and the collar 74 as described with regard to FIGS. 9 and 10). Then the tool 84 can be pushed down farther to compress spring 88 and cause the friction-held sleeve 90 to slide down past the dogs 48 and down over the tip 86. As the sleeve 90 then covers the shoulder of the tip 86, the tool assembly 84 can be pulled up (without raising the guide 22) and withdrawn through the caisson 20. Note that this type of tool 84 could also be used as a running tool for the embodiment in FIG. 3.

Figure 11:
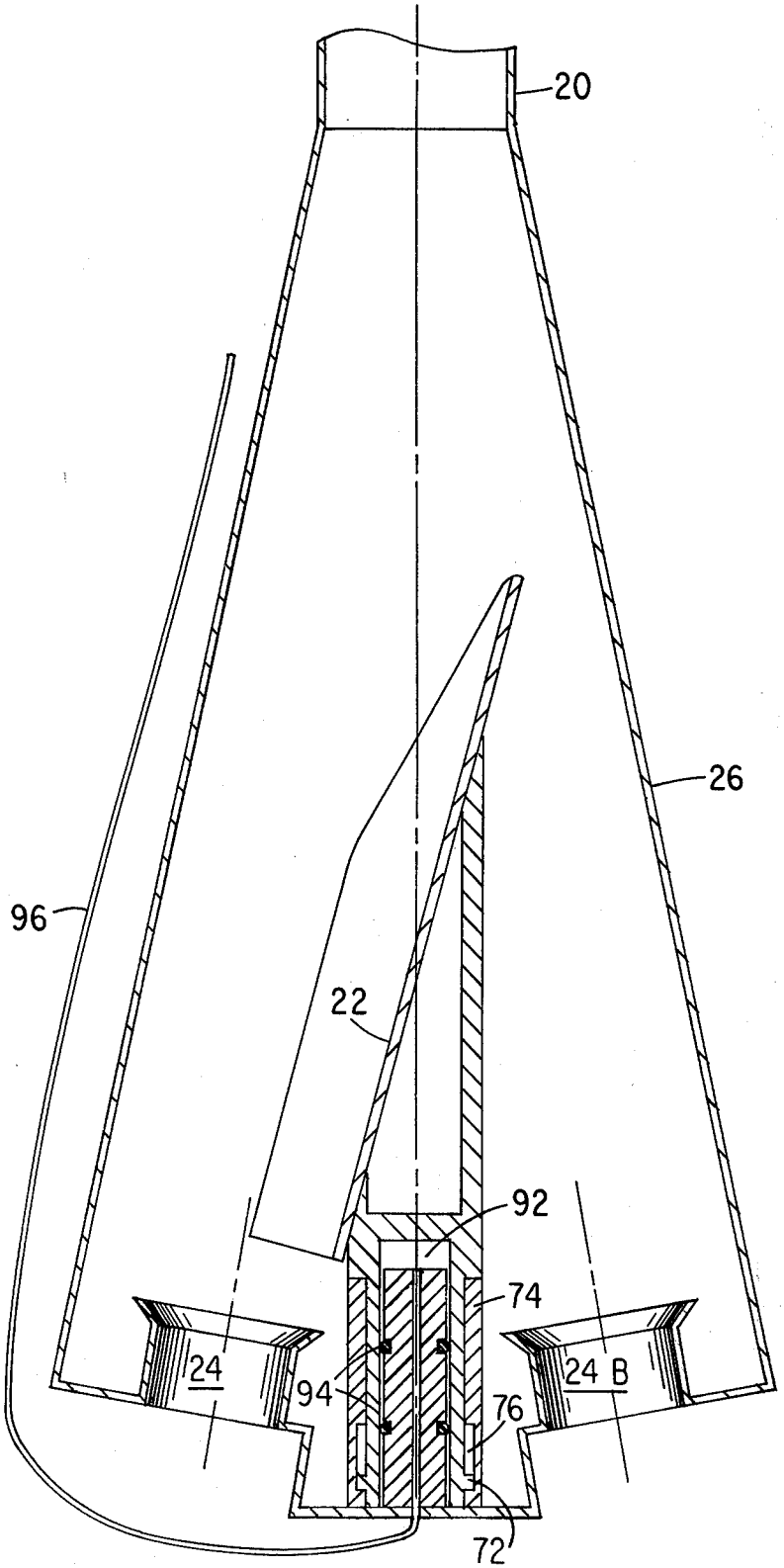
FIG. 11 is an elevation, partly in section, of a ratcheting type of embodiment where a piston is used to lift and then lower the guide.

As an alternative to the mechanical lifting arrangement shown in FIG. 8, FIG. 11 shows an embodiment in which the guide 22 is lifted and then lowered (or allowed to lower) by a piston 92 positioned between the bottom section 26 and the guide means 22. When pressure is applied, the piston is capable of lifting and then lowering the guide means 22 the predetermined distance (determined by the vertical distance between the high point and the low point of the groove 76 in the collar 74) to cause the ratcheting means (generally the pins 72 and the collar 74) to reorient guide means 22. The piston 92 has piston rings 94 to generally prevent leakage. The piston 92 can be operated from the surface by applying pressure through tubing 96.

A position indicator (not shown) can be installed to indicate the orientation of the guide 22. For example, a cam on the periphery of the guide in the direction to which the guide 22 is oriented could actuate a cam-actuated position-indicating valve (one of which would be provided for each exit hole and connected by tubing to the surface). Pressure could be supplied by one tube to all position-indicating valves and sensed at the appropriate position-indicating tube at the surface.

The piston embodiment can save considerable drilling time. Even with this configuration it is still preferred, however, to have an appropriate mechanical lifting adapter attached to the guide means 22 so that a wireline tool arrangement such as shown in FIG. 8 can act as a backup for the piston 92.

Although this invention is especially suited for use where a limited number of wells are to be drilleed and a single free-standing riser caisson is used, the apparatus can also be used as part of a multi-leg platform. The bottom section and orientable guide means combination can be used in effectively the same way at the lower end of one or more legs (with a leg serving as a riser caisson) of a multi-leg platform. Thus, in a vertically moored platform of the type of the aforementioned U.S. Pat. Nos. 3,559,410 and 3,648,368, for example, multiple wells could be installed in one or more of the riser caissons (legs) with the diameter of the largest size well casings being such that these largest casings from all of the wells at the bottom of one riser caisson would not simultaneously fit in that riser caisson. This provides great flexibility of design. A larger number of wells can be drilled from a given size platform or the number and/or diameter of legs can be reduced.

The invention is not to be construed as limited to the particular forms disclosed herein, since these are to be regarded as illustrative rather than restrictive. The invention is intended to cover all configurations which do not depart from the spirit and scope of the invention.

I claim:

1. A multiple well platform apparatus especially suited for deepwater production of hydrocarbons using at least three different size casings in each well, said apparatus comprising:

a. a free-standing single riser caisson adapted to extend from about the marine bottom to above the water level;

b. at least one buoyancy chamber attached to the upper portion of said caisson;

c. a bottom section connected to the lower end of said single riser caisson, said bottom section having a plurality of generally downward-looking exit holes, each said exit hole being adapted to have a largest size casing mounted in said exit hole with the top of said largest size casing being at about the level of the said exit hole and with the diameter of said largest size well casing compared to the diameter of said single riser caisson being such that the largest casings from all of said exit holes would not simultaneously fit in said single riser caisson; and d. an orientable guide means located inside and generally on the vertical axis of said bottom section which guide means can be oriented to direct well drilling apparatus to any one of said exit holes such that wells can be drilled and casings installed through said exit holes.

2. The apparatus of claim 1, wherein a keying means is mounted within said bottom section to allow orientation of said guide means with respect to said exit holes, and said guide means has a key mating means fastenable in said guide means, whereby the configuration of said key mating means relative to said guide means and said keying means determines to which exit hole said well drilling apparatus will be directed.

3. The apparatus of claim 1, wherein a ratcheting means is attached to said guide means and to said bottom section such that lifting said guide means and then lowering said guide means reorients said guide means to an adjacent exit hole.

4. The apparatus of claim 3, wherein a piston is positioned between said bottom section and said guide means, said piston being capable of lifting and then lowering said guide means to cause said ratcheting means to reorient said guide means.

5. The apparatus of claim 3, werein a mechanical lifting adapter is attached to said guide means whereby a mechanical lifting means may be attached to said guide means to lift and then lower and thereby reorient said guide means.

6. An apparatus for a multiple well platform especially suited for deepwater production of hydrocarbons using at least three different size casings in each well and using a riser caisson adapted to extend from about the marine bottom to above the water level, said apparatus comprising:

a. a bottom section connectable to the lower end of said riser caisson, said bottom section having a plurality of generally downward-looking exit holes, each said exit hole being adapted to have a largest size casing mounted in said exit hole with the top of said largest size casing being at about the level of the said exit hole and with the diameter of said largest size well casing compared to the diameter of said riser caisson being such that the largest casings from all of said exit holes would not simultaneously fit in said riser caisson; and b. an orientable guide means located inside and generally on the vertical axis of said bottom section which guide means can be oriented to direct well drilling apparatus to any one of said exit holes such that wells can be drilled and casings installed through said exit holes.

7. The apparatus of claim 6, wherein a keying means is mounted within said bottom section to allow orientation of said guide means with respect to said exit holes, and said guide means has a key mating means fastenable in said guide means, whereby the configuration of said key mating means relative to said guide means and said keying means determines to which exit hole said well drilling apparatus will be directed.

8. The apparatus of claim 6, werein a ratcheting means is attached to said guide means and to said bottom section such that lifting said guide means and then lowering said guide means reorients said guide means to an adjacent exit hole.

9. The apparatus of claim 8, wherein a piston is positioned between said bottom section and said guide means, said piston being capable of lifting and then lowering said guide means to cause said ratcheting means to reorient said guide means.

10. The apparatus of claim 8, wherein a mechanical lifting adapter is attached to said guide means whereby a mechanical lifting means may be attached to said guide means to lift and then lower and thereby reorient said guide means.

* * * * *